United States Patent [19]

Lucius

[11] Patent Number: 4,655,718

[45] Date of Patent: Apr. 7, 1987

[54] PERSONAL FLOTATION DEVICE WITH AUXILIARY PADS

[75] Inventor: John H. Lucius, Wichita, Kans.

[73] Assignee: The Coleman Company, Inc., Wichita, Kans.

[21] Appl. No.: 789,380

[22] Filed: Oct. 21, 1985

[51] Int. Cl.[4] ..... B63C 9/10

[52] U.S. Cl. ..... 441/106; 441/112; 441/116; 441/119

[58] Field of Search ..... 441/106–119

[56] References Cited

U.S. PATENT DOCUMENTS 1,065,385 6/1913 Bailey ..... 441/115

FOREIGN PATENT DOCUMENTS 129965 7/1920 United Kingdom ..... 441/116

*Primary Examiner*—Sherman D. Basinger

[57] ABSTRACT

A personal flotation device is provided with auxiliary pads for partially closing the arm openings. The pads are attached to the back of the flotation device, and a strap is attached to each pad. The pads can be maintained at the lower portion of the arm openings by connecting the straps in front of the flotation device. When the straps are not connected, the pads hang freely from their attachment points at the back.

5 Claims, 4 Drawing Figures

PERSONAL FLOTATION DEVICE WITH AUXILIARY PADS

BACKGROUND AND SUMMARY

This invention relates to personal flotation devices, and, more particularly, to a personal flotation device with auxiliary pads for partially closing the arm openings of the flotation device.

Personal flotation devices or life jackets are conventionally provided in the form of a vest which has a pair of arm openings. The user of a personal flotation device frequently engages in activities which require freedom of arm movement, and it is desirable that the arm openings be sufficiently large so that the vest does not unduly restrict the desired movement. However, it is also desirable that the personal flotation device provide sufficient buoyancy to protect the wearer in the event of a mishap.

As an example, bass fishermen commonly use high speed boats to race to the fishing site. Thereafter, they engage in enthusiastic fishing activity. It is desirable that the personal flotation device provide sufficient safety during high speed racing while allowing free arm movement during fishing.

The invention provides a personal flotation vest with auxiliary pads for reducing the size of the arm openings. Each pad is attached to the back edge of one of the arm openings in the vest, and a strap is attached to the front of the pad. When the straps are connected in front of the vest, the pads reduce the size of the arm openings. The pads therefore reduce the possibility that the vest will be pulled off in the event of a high speed water impact, provide additional cushioning during impact, and provide additional buoyancy during flotation. When the straps are disconnected, the pads hang loosely down from the back of the arm openings, thereby enlarging the size of the openings and increasing the wearer's comfort and freedom of movement.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
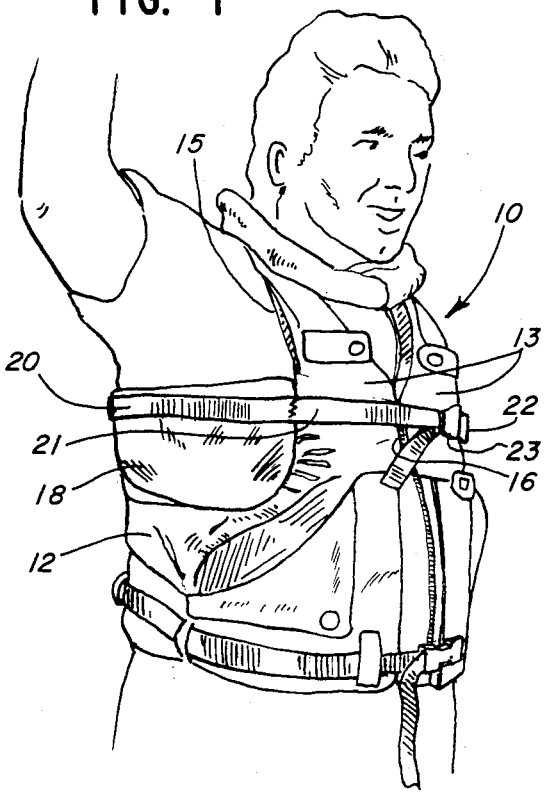
FIG. 1 is a front perspective view of a personal flotation device provided with auxiliary arm opening pads in accordance with the invention.

Referring to the drawing, the numeral 10 designates generally a personal flotation device in the form of a vest having a back portion 11, a pair of side portions 12, and a pair of front portions 13. The front portions are attached to the back portion at the shoulders 14. An arm opening 15 is provided in each side. The vest is secured by a zipper 16 which connects the edges of the two front portions.

The vest heretofore described may be a conventional life vest or personal flotation device. Such a vest is commonly constructed of internal pads of buoyant material and an outer cover of nylon or similar material which completely encloses the pads.

Figure 3:
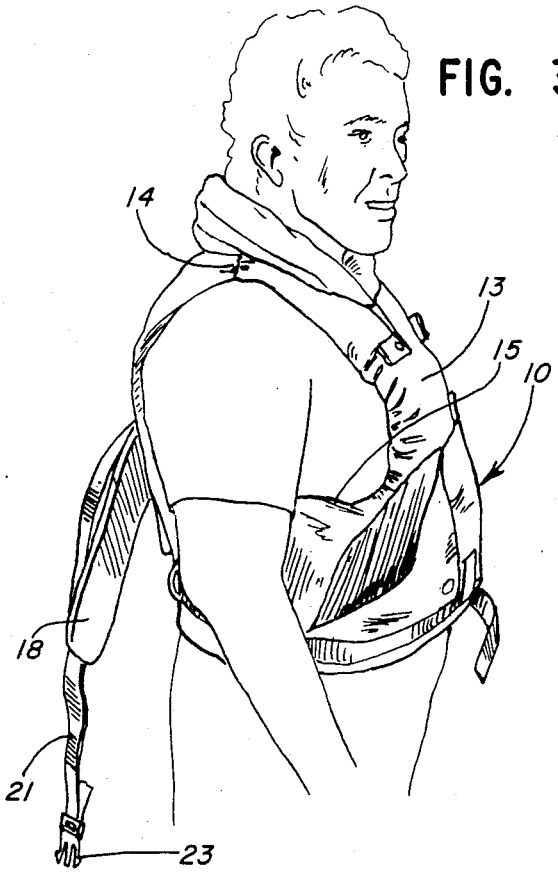
FIG. 3 is a perspective view showing the auxiliary pads detached and hanging loosely.
Figure 2:
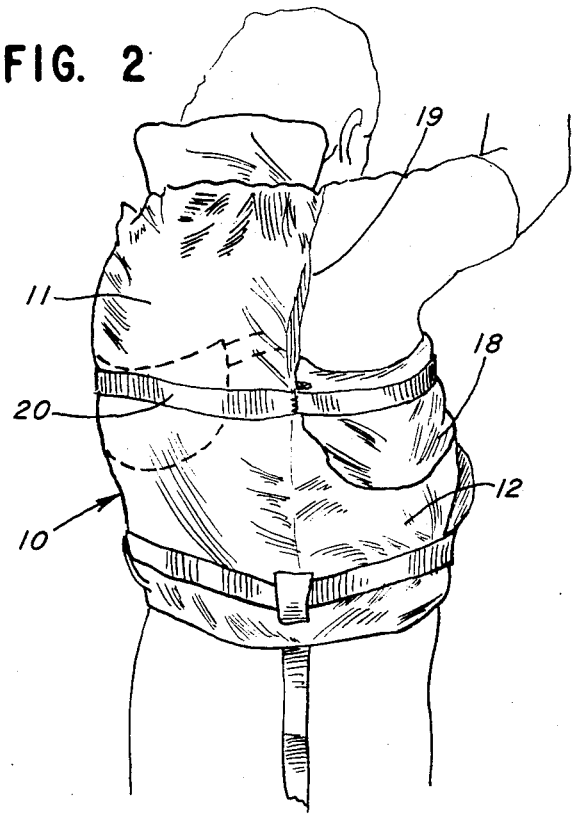
FIG. 2 is a rear perspective view of the device of FIG. 1.

As can be seen in FIG. 3, the size of the arm openings in the vest are relatively large to permit free and unrestricted arm movement and to increase the comfort of the wearer. An auxiliary pad 18 is connected to the back edge 19 of each arm opening, and a strap 20 extends around the back of the vest and across the auxiliary pads. The strap 20 is stitched to the back edge of each opening and is stitched to the front edge of each pad. The strap 20 includes a pair of front portions 21 and 22 and buckles 23 and 24 on the front portions.

When the front portions of the strap are pulled around the front of the vest and connected by the buckles 23 and 24 as shown in FIG. 1, the auxiliary pads are pulled across the lower portions of the arm openings 18 under the armpits of the wearer. In this position the auxiliary pads reduce the size of the arm openings and make the vest more secure on the wearer in the event the wearer hits the water. The auxiliary pads also provide additional cushioning during impact and additional buoyancy.

Figure 4:
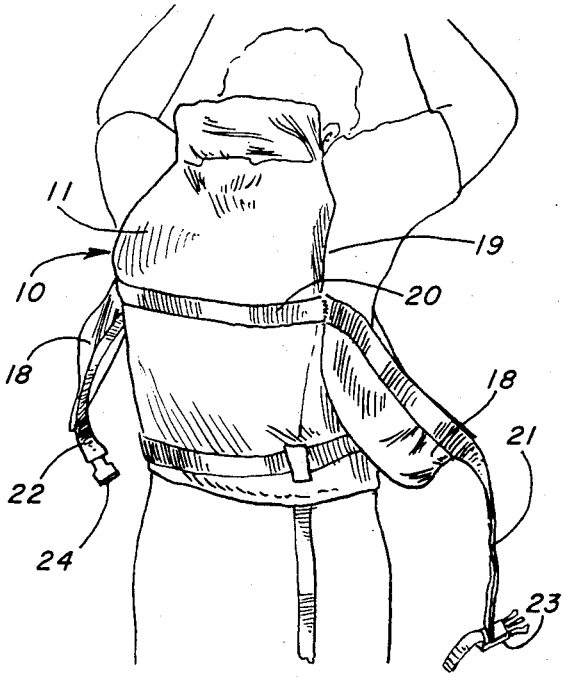
FIG. 4 is a rear perspective view of the device of FIG. 3.

When the front straps 21 and 22 are disconnected as shown in FIGS. 3 and 4, the auxiliary pads hang loosely down from their attachment at the rear edges of the arm openings. The arm openings are no longer restricted by the pads, and the wearer has freedom of movement.

Each of the auxiliary pads can be formed from the same material as the vest, namely, an internal pad of buoyant material and an outer cover of nylon or similar material. The pad can be attached to the vest by inserting the rear portion of the cover of the pad between the front and rear portions of the cover of the vest at the back edge of the arm opening and stitching the material together. Each pad is elongated and somewhat rectangular in shape so that it extends fully across the width of the arm opening but covers only about the lower half thereof.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A personal flotation device comprising a vest formed from buoyant material and a cover enclosing the buoyant material, the vest having a front, a back, and two sides, each of the sides being provided with an arm opening of sufficient size so that it does not interfere with movement of the upper arm of the wearer, a pair of pads permanently and flexibly attached only to the back of the vest, each of the pads being attached to the back of the vast adjacent one of the arm openings, a front strap attached to each pad, and means for releasably connecting the front straps in front of the vest for maintaining each pad in the lower portion of the arm opening, the attachment between the pads and the back of the vest permitting the pads to hang downwardly away from the arm openings when the front straps are not connected.

2. The device of claim 1 including a back strap which is attached to each of the pads and extends around the back of the vest.

3. The device of claim 1 in which each of the pads is attached to the back edge of one of the arm openings in the vest.

4. The device of claim 1 in which each of the pads is buoyant.

5. The device of claim 1 in which each of the pads includes an internal pad of buoyant material and a cover enclosing the buoyant material.

* * * * *